US006564522B1

(12) United States Patent
Chiu-Ying

(10) Patent No.: US 6,564,522 B1
(45) Date of Patent: May 20, 2003

(54) HIDDEN DUAL LOADING SPRING-TYPE FLOOR BOARD FASTENING MOUNT STRUCTURE

(76) Inventor: Lee Chiu-Ying, No. 29, Alley 51, Lane 851, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/989,586

(22) Filed: Nov. 20, 2001

(51) Int. Cl.[7] ..... E04F 15/22
(52) U.S. Cl. ..... 52/480; 52/403.1
(58) Field of Search ..... 52/480, 403.1, 52/463, 464, 470, 391

(56) References Cited

U.S. PATENT DOCUMENTS 1,977,496 A * 10/1934 Snyder et al. ..... 404/47
2,862,255 A * 12/1958 Nelson ..... 52/403.1
3,045,294 A * 7/1962 Livezey ..... 52/223.7
3,387,422 A * 6/1968 Wanzer ..... 52/387
3,518,800 A * 7/1970 Tank ..... 52/480
3,553,919 A * 1/1971 Omholt ..... 52/480
4,703,601 A * 11/1987 Abendroth ..... 52/509
5,671,575 A * 9/1997 Wu ..... 52/403.1
6,122,873 A * 9/2000 Randjelovic ..... 52/391

* cited by examiner

*Primary Examiner*—Carl D. Friedman
*Assistant Examiner*—Jennifer I. Thissell

(57) ABSTRACT

A hidden dual loading spring-type floor board fastening mount structure comprised of a plurality of wooden floor boards, fastening mounts, and lengths of soft padding. Each wooden floor board has a tongue and a groove respectively formed along its long and short sides, with the fastening mount having a first tang and a second tang projecting upward from its top surface that enables engagement to the wooden floor boards. The fastening mount has a T-shaped slide block extending from one side and a T-shaped recess formed in its other side. In the invention herein, since the T-shaped slide block of the fastening mount is inserted into the T-shaped recess of another fastener mount and, furthermore, two in-line stays are postured against the two spring holes of another fastener mount, the two adjacent fastener mounts are interconnected into a flexibly extendible and retractable, tie member-form, floor board fastening mount structure, which effectively facilitates the installation of the wooden floor boards.

3 Claims, 3 Drawing Sheets

X-X

HIDDEN DUAL LOADING SPRING-TYPE FLOOR BOARD FASTENING MOUNT STRUCTURE

BACKGROUND OF THE INVENTION

1) Field of the Invention

The invention herein relates to floating-floor systems and specifically is a hidden dual loading spring-type floor board fastening mount structure.

2) Description of the Prior Art

Of the many varieties of conventional indoor flooring available, carpeting and plastic flooring are typically the most common. However, carpet cleaning and sanitation maintenance is difficult and plastic flooring is easily defaced by wear due to its material characteristics. In contrast, an ordinary wooden floor is easier to maintain and clean and, furthermore, has the advantage of retaining its shape. However, when a conventional wooden flooring is actually installed, since a foundation plate must be built over the concrete subfloor and the wooden floor boards have to be glued to it, this involves considerable construction effort and time and is inefficient. Furthermore, if the conjoinment structure between the wooden floor boards contracts or expands due extreme cold or heat, the wooden floor becomes deformed or buckles into an uneven surface, and the service life of the floor and its usability may even be affected. Therefore, manufacturers await researched improvements to the installation shortcomings of the said wooden flooring.

In view of the said situation, the inventor of the invention herein conducted research to effect improvement based on many years of experience gained while engaged in wood flooring research that involved extensive sample fabrication and testing until proven results were achieved, which culminated in the successful development of the invention herein.

SUMMARY OF THE INVENTION

The primary objective of the invention herein is to provide a hidden dual loading spring-type floor board fastening mount structure comprised of a plurality of wooden floor boards, fastening mounts, and lengths of soft padding; each said wooden floor board has a tongue and a groove formed contiguously along the center of its respective long and short sides; said fastening mount has a first tang and a second tang projecting upward from its top surface that enables engagement to the wooden floor boards; the said fastening mount has a T-shaped slide block extending from one side and a T-shaped recess formed in the bottom surface of its other side; since the T-shaped slide block of the said fastening mount of the invention herein is inserted into the T-shaped recess of another fastener mount and, furthermore, two in-line stays are postured against the said two spring holes of another fastener mount, the two adjacent fastener mounts are interconnected into a flexibly extendible and retractable, tie member-form, floor board fastening mount structure; as such, the wooden floor board conjoinment structure of the invention herein provides for rapid installation, low production cost capability, and ventilation to counter moisture accumulation and, furthermore, requires no nailing or adhesive application, which prevents the buckling out of shape of the wooden floor boards; furthermore, the soft padding of the invention herein buffers vibration and absorbs sound; therefore, the invention herein increases the usable service life of the wooden floor boards and enhances floor installation efficiency.

DETAILED DESCRIPTION OF THEE INVENTION

Figure 1:
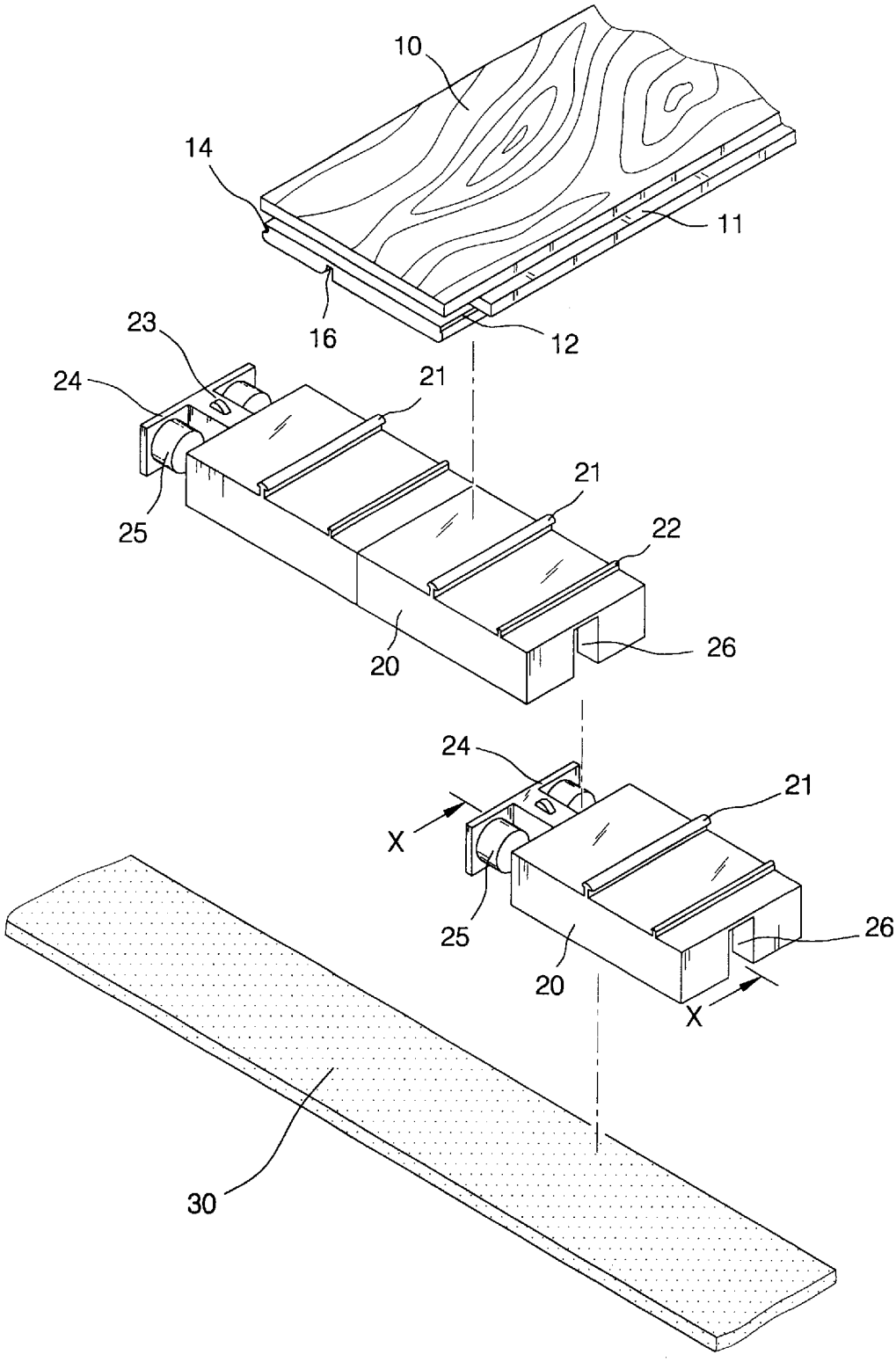
FIG. 1 is an exploded drawing of the wooden floor board fastening mount structure of the invention herein.
Figure 2:
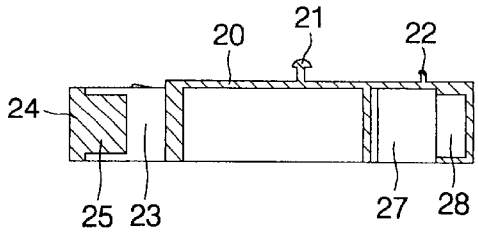
FIG. 2 is a cross-sectional drawing of the fastening mount in FIG. 1, as viewed from the perspective of line X.
Figure 3:
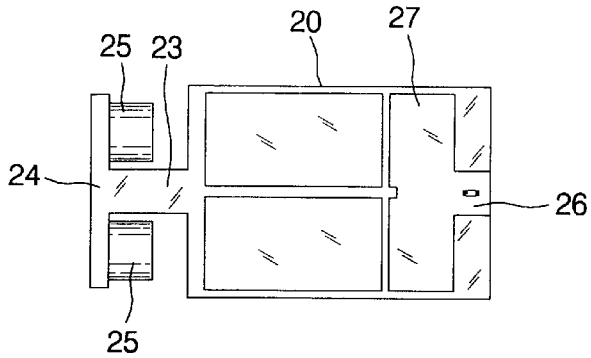
FIG. 3 is an orthographic drawing of the fastening mount in FIG. 1, as viewed from the top.
Figure 4:
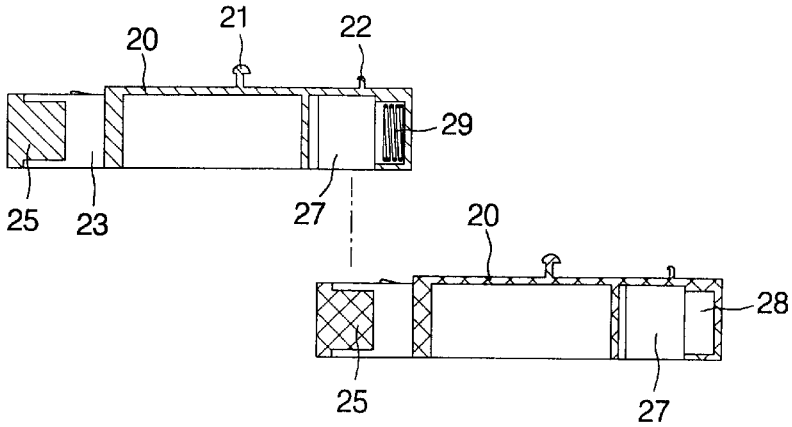
FIG. 4 is a cross-sectional drawing of two adjacent fastening mounts that illustrates the upper and lower lateral end interconnection particulars.

Referring to the accompanying drawings, the invention herein is a hidden dual loading spring-type floor board fastening mount structure comprised of a plurality of wooden floor boards 10, fastening mounts 20, and lengths of soft padding 30, of which:

Each said wooden floor board 10 consists of a rectangular plank of lumber having a tongue 11 protruding contiguously along the center of one long side and one short side as well as a groove 13 formed contiguously along the center of its other long side and short side that enables two wooden floor boards 10 to be aligned and assembled together into a single structural entity; a first anchoring slot 14 is disposed parallel to the bottom lateral edge of the groove 13 of the said long side and a second.anchoring slot 12 is disposed parallel to the bottom lateral edge of the tongue 11 of the said long side; and a locating slot 16 is formed in a parallel arrangement at an appropriate position in the bottom surface of the said wooden floor board 10.

Figure 5:
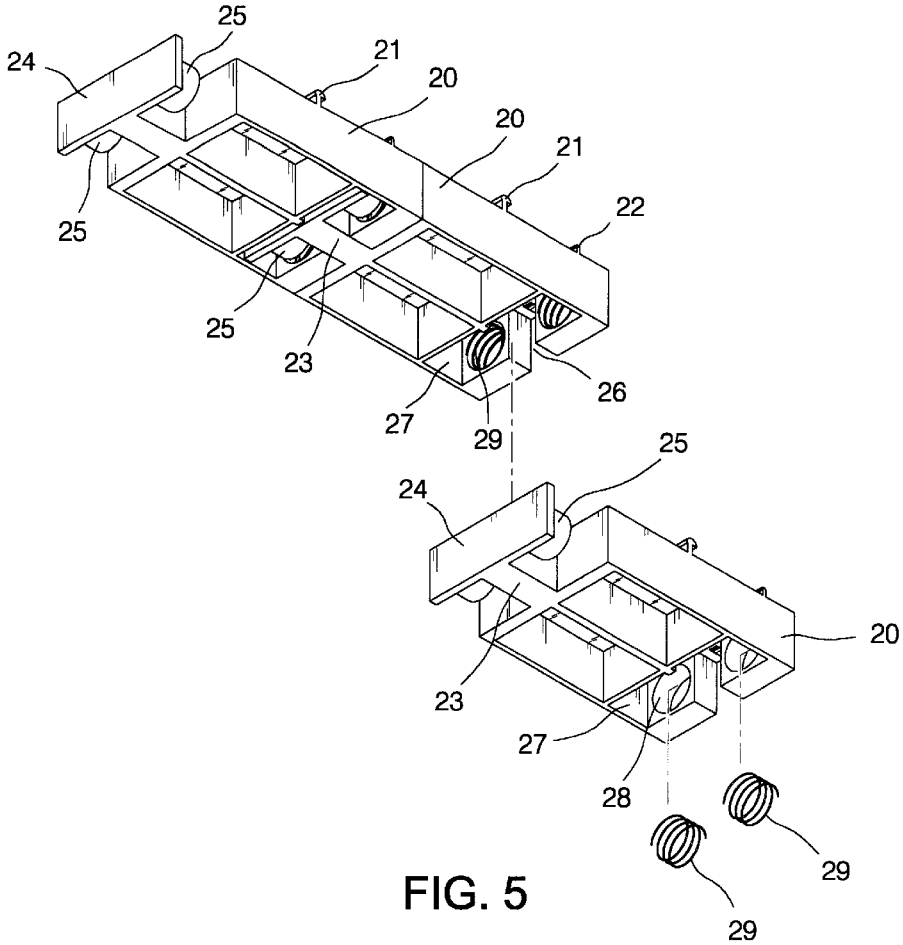
FIG. 5 is an exploded drawing of two adjacent fastening mounts that illustrates the bottom section interconnection details.
Figure 6:
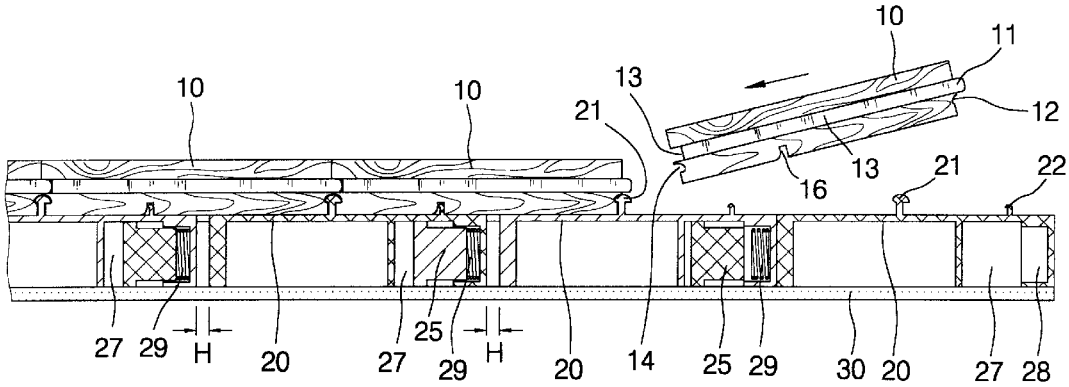
FIG. 6 is a cross-sectional drawing of installed wooden floor boards and the fastening mounts.

Each said fastening mount 20 is fabricated of a plastic material into a rectangular junctional platform, with the said fastening mount 20 having formed along its top surface an upward projecting first tang 21 and second tang 22; the two barbs at the top edge of the said first tang 21 are respectively aligned with and engaged between the first anchoring slot 14 of the said wooden floor board 10 and the second anchoring slot 12 of another wooden floor board 10 and the second tang 22 at the top surface of the said fastening mount 20 is aligned with and engaged into the locating slot 16 in the bottom surface of the said wooden floor board 10; the said fastening mount 20 has a T-shaped slide block 23 extending from one side and two stays 25 protrude in alignment inside the top plate 24 of the said T-shaped slide block 23; the said fastening mount 20 has formed in the bottom surface of its other side a correspondingly profiled T-shaped recess 27 that enables the lateral ends of two fastening mounts 20 to be aligned and connected together into a single structural entity; two spring holes 28 are disposed at the two sides of the T-shaped recess 27 guide channel 26 and, furthermore, a spring 29 is placed inside each of the said two spring holes 28; the two stays 25 of another fastening mount 20 are slipped in against the spring 26 components inside the said two spring holes 28, enabling two fastening mounts 20 to be assembled into an elastic extendible and retractable, tie member-form, floor board fastening.mount structure (as shown in FIG. 1, FIG. 5, and FIG. 6) and, furthermore, since the spring-loaded coupling structure between the two fastener mounts 20 is tightly tensioned, movement and loosening cannot occur.

The said soft padding 30 is a pliant sponge-like lining that is situated along the bottom surface of the said fastener mount 20 and has vibration buffering, anti-slip, and noise absorption capability.

In the hidden dual loading spring-type floor board fastening mount structure of invention herein, since a pair of internal compressed springs 29 forcefully maintain the assembly of adjacent fastener mounts 20 and, furthermore, a plurality of fastener mounts 20 can be interconnected to increase length, a plurality of wooden floor boards 10 can be horizontally aligned, straddled, and fitted into position on the top surfaces of the said adjacent fastener mounts 20; furthermore, the conjoinment surface between the said two adjacent wooden floor boards 10 are fastened to the conjoinment surface between the said two adjacent fastener mounts 2 in an intervallic crisscross arrangement and the center section position at the short side of the said wooden floor boards 10 are secured through downward pressure onto the conjoinment surface at the top end position of the said two adjacent fastener mount 20 (as shown in FIG. 6); the first anchoring slot 14 and the second anchoring slot 12 at the two long sides of the said wooden floor boards 10 are respectively aligned and elastically engaged between the first tangs 21 on the said two adjacent fastener mounts 20 and due to the downward press-fit assembly of the said wooden floor boards 10, this enables the two stays 25 on the said fastener mount 20 to be horizontally aligned and inserted against the spring 29 components inside the two spring holes 28 of another fastener mount 20 such that a gap of a certain distance H (as shown in FIG. 6) is produced between two adjacent fastener mounts 20 and the arrangement of the said two adjacent fastener mounts 20 results in a corresponding relationship with the said wooden floor boards 10 and soft padding 30 that yields a flexible retractable and extendible, tie member-form, fastener mount structure and, furthermore, the elastic horizontal movement process of which is stable and precise; as such, the wooden floor board 10 conjoinment structure of the invention herein supports rapid installation and affords low production cost capability and, furthermore, requires no nail hammering or adhesive application, and resists buckling and creeping due to temperature-induced contraction and expansion; furthermore, the soft padding 30 of the invention herein situated along the bottom surface of the said fastener mount 20 is a sheet of extended length that buffers vibration, prevents slipping, and absorbs sound at the wooden floor boards 10, while also providing for wooden floor board 10 ventilation and thereby guards against moisture, with the usable service life of the wooden floor boards 10 effectively prolonged because they are not glued to the subfloor; and since electrical wiring, water pipes, and other conduits can be routed along the sides of the said fastener mounts 20, the flooring installation of the invention herein is of increased practicality and utility.

In summation of the foregoing section, the hidden dual loading spring-type floor board fastening mount structure of the invention herein consists of a fastener mount 20 having a T-shaped slide block 23 that is inserted into the T-shaped recess 27 of another fastener mount 20 and, furthermore, the two in-line stays 25 are slipped in against the spring 26 components inside the said two spring holes 28 of another fastener mount 20, enabling the two adjacent fastener mounts 20 to be assembled into a flexibly extendible and retractable, tie member-form, floor board fastening mount structure; furthermore, utilizing the upper and lower crisscrossed insertional conjoinment assembly arrangement between the wooden floor boards 10 and the fastening mounts 20 subjects the conjoinment surfaces of the said two adjacent fastening mounts 20 to the downward loading force exerted by the weight of the wooden floor boards 10, which prevents the drawback of buckling and creeping; furthermore, the invention herein is easy to install and uninstall, can be constructed rapidly, and the wooden floor boards 10 have enhanced noise reduction properties; as such, the flooring installation structure of the invention herein is progressive and original and, therefore, meets new patent application requirements and is lawfully submitted in application thereof.

What is claimed is:

1. A hidden dual loading spring-type floor board fastening mount structure comprised of a plurality of wooden floor boards, a plurality of fastening mounts, and lengths of soft padding, wherein:

each said wooden floor board consists of a rectangular plank of lumber having a tongue and a groove formed contiguously along a center of its respective longer and shorter sides, a first anchoring slot is disposed parallel to a bottom lateral edge of said groove, a second anchoring slot is disposed parallel to a bottom lateral edge of said tongue, and a locating slot is formed in a bottom surface of said wooden floor board;

each said fastening mount consists of a rectangular junctional platform, and has a top surface formed with an upward projecting first tang and an upward projecting second tang; two barbs at a top edge of said first tang are respectively aligned and engaged between said first anchoring slot of one said wooden floor board and said second anchoring slot of another said wooden floor board, said second tang is aligned with and engaged into said locating slot of said wooden floor board, each said fastening mount has a first side provided with a T-shaped slide block, two stays protrude inward from a top plate of said T-shaped slide block; each said fastening mount has a second side formed with a T-shaped recess having a guide channel which has two sides each formed with a spring hole for receiving a spring;

said soft padding is situated along a bottom surface of said fastener mounts; and said T-shaped slide block of each said fastening mount is inserted into said T-shaped recess of another said fastener mount, and each of said two stays is urged on said spring in said spring hole of another said fastener mount.

2. As mentioned in claim 1 of the hidden dual loading spring-type floor board fastening mount structure of the invention herein, a center section position at shorter sides of each said wooden floor board is secured through a downward pressure onto an joining surface at a top end position of each said two adjacent fastener mounts.

3. As mentioned in claim 1 of the hidden dual loading spring-type floor board fastening mount structure of the invention herein, a gap of a certain distance is produced between each said two adjacent fastener mounts by a compression force of said spring.

* * * * *